United States Patent [19]

Rasmussen et al.

[11] Patent Number: 4,721,503

[45] Date of Patent: Jan. 26, 1988

[54] AGRICULTURAL STORAGE BAG FOLDING APPARATUS AND METHOD

[75] Inventor: David H. Rasmussen, Walter L. Jay, both of Blair, Nebr;

[73] Assignee: Ag-Bag Corporation, Astoria, Oreg.

[21] Appl. No.: 61,609

[22] Filed: Jun. 18, 1987

Related U.S. Application Data

[63] Continuation of Ser. No. 708,557, Mar. 5, 1985, abandoned.

[51] Int. Cl.[4] ..... ..... B65H 45/107; B31B 1/26

[52] U.S. Cl. ..... 493/413; 493/217; 493/240; 493/406; 493/451; 493/940

[58] Field of Search ..... 493/37, 217, 413, 451, 493/940, 941

[56] References Cited

U.S. PATENT DOCUMENTS

| | | | |
|---|---|---|---|
| 3,279,784 | 10/1966 | Schwendinger | 493/413 |
| 3,495,505 | 2/1970 | Hansson et al. | 493/302 |
| 3,533,924 | 1/1971 | Bonaini | 204/67 |
| 3,921,506 | 11/1975 | Hollis | 493/22 |
| 3,924,522 | 9/1975 | Martin | 493/287 |
| 4,002,006 | 1/1977 | Bruno | 53/459 |
| 4,027,460 | 6/1977 | Orr | 53/535 |
| 4,106,398 | 8/1978 | Buisson | 493/356 |
| 4,265,439 | 5/1981 | Sundberg | 493/451 |
| 4,340,379 | 7/1982 | Williamson | 493/211 |
| 4,424,051 | 1/1984 | Lee | 493/37 |

FOREIGN PATENT DOCUMENTS

| | | |
|---|---|---|
| 766889 | 9/1967 | Canada . |
| 460215 | 3/1975 | U.S.S.R. . |

*Primary Examiner*—Robert P. Olszewski
*Assistant Examiner*—William E. Terrell
*Attorney, Agent, or Firm*—Michael A. O'Neil

[57] ABSTRACT

An apparatus for folding agricultural storage bags (20) includes a frame (22) having an annular pad (70) mounted about the lateral periphery thereof. Pivotally mounted within and extending outwardly from the frame above the annular pad (70) are a plurality of upper arms (110). A plurality of lower arms (126) are similarly mounted below the annular pad (70) and are positioned between the upper arms (110). Mounted within the frame (22) above the upper arms (110) is a platform (26) for supporting a quantity of flexible tubular material. Mounted to the frame above the platform (26) is an advancing mechanism (50). The upper and lower arms (110 and 126) are actuated alternately to form the length of flexible tubular material into a plurality of folds each extending parallel to the annular pad (70).

21 Claims, 11 Drawing Figures

AGRICULTURAL STORAGE BAG FOLDING APPARATUS AND METHOD

CROSS-REFERENCE TO RELATED APPLICATIONS

This application is a continuation of application Ser. No. 06/708,557, filed Mar. 5, 1985, now abandoned.

TECHNICAL FIELD

This invention relates generally to a folding apparatus and, more particularly, to a folding apparatus adapted for use in conjunction with large diameter, elongate, flexible tubular members, such as agricultural storage bags, and the like. The inventors of the subject matter disclosed and claimed herein are David H. Rasmussen and Walter L. Jay.

BACKGROUND AND SUMMARY OF THE INVENTION

Traditionally, agricultural products such as hay, grain, silage, field crops and the like have been stored in permanent structures. Barns, sheds, silos and other permanent structures erected near the fields in which the crops are produced have typically been utilized for such purposes.

Although permanent structures are generally weatherproof and provide secure storage for agricultural products, there exist numerous drawbacks to their use. In addition to the relatively high cost of constructing and maintaining such structures, specialized equipment is often required to load or unload agricultural products therefrom. Considerable labor is also involved is handling and transporting agricultural products between the fields and such fixed storage facilities. For example, hay grown in a particular field may later be used to feed livestock grazing in the same field, requiring transport to and from a permanent storage facility. The use of remotely located storage structures thus involves unnecessary handling of the agricultural products, which is both time consuming and expensive in terms of labor cost. Additionally, permanent storage structures are generally not sealed or airtight, contributing to shrinkage, spoilage and losses in the nutritional value of agricultural product stored therein.

More recently, temporary structures have been developed for the storage of agricultural products. For example, agricultural storage bags have been used in conjunction with silage compression apparatus for in-field storage of agricultural products, thus eliminating the need for permanent storage facilities and the expenses associated therewith. An important benefit deriving from the use of agricultural storage bags involves the ability to provide airtight storage, thus eliminating the losses in the nutritional value of stored agricultural products characterized by other storage techniques.

Agricultural storage bags actually comprise large diameter, elongate, flexible plastic tubes. For example, a typical agricultural storage bag may have a diameter of up to 9 feet or more and a length of up to 135 feet or more. Agricultural storage bags are folded prior to shipment, and are thereafter mounted on the housing or tunnel of a silage compression machine in the folded condition. The silage compression machine functions to feed and compress agricultural material into the agricultural storage bag. As material is fed into the storage bag, the silage compression machine slowly moves away from the built up mass of compressed material, thereby pulling the bag off of the rear of the tunnel of the silage compression machine.

U.S. Pat. No. 4,424,051, granted to Richard H. Lee, Steven R. Cullen, Eddie H. Bailen, David H. Rasmussen and William C. Johnson on Jan. 3, 1984, relates to a method of and apparatus for manufacturing two-ply agricultural storage bags. In accordance with the method disclosed therein, each bag accumulates on a horizontally disposed table as assembly progresses. This causes the bag to form into a series of accordion-like folds, that is, a series of folds each extending perpendicularly to the longitudinal axis of the bag. In actual practice, it has been found that superior results are obtained when agricultural storage bags are formed into so-called "flat folds", that is, folds extending parallel, rather than perpendicular, to the longitudinal axis of the bag. Specifically, flat folded bags are easier to install on the tunnel of a silage compression machine prior to use and tend to pull off of the tunnel of a silage compression machine during silage compression operations more uniformly than is the case with bags folded in an accordion-like manner.

The present invention relates to a method of and apparatus for forming flat-folded agricultural storage bags. In accordance with the broader aspects of the invention, an agricultural storage bag is advanced longitudinally until the leading end thereof surrounds an annular pad. A plurality of lower arms, which are disposed circumferentially about the lower end of the annular pad, are then extended to engage the exterior of the bag, thereby gripping the leading end of the bag against the annular pad. A plurality of upper arms are disposed circumferentially about the upper end of the annular pad. The upper arms are extended to fold the unsecured portion of the bag trailing the leading end thereof over the lower arms, thereby gripping the first fold of the bag and the leading end thereof against the annular pad. The lower arms are then withdrawn from between the leading end of the bag and the first fold and are thereafter immediately reextended to engage the exterior of the first fold, thereby gripping the first fold and the leading end of the bag against the annular pad. The foregoing steps are repeated until the entire length of the agricultural storage bag has been accumulated in a plurality of flat folds. The bag is then secured in the folded condition and removed from the apparatus.

DESCRIPTION OF THE DRAWINGS

A more complete understanding of the invention may be had by reference to the following Detailed Description when taken in conjunction with the accompanying Drawings, wherein.

DETAILED DESCRIPTION

A. Apparatus

Figure 1:
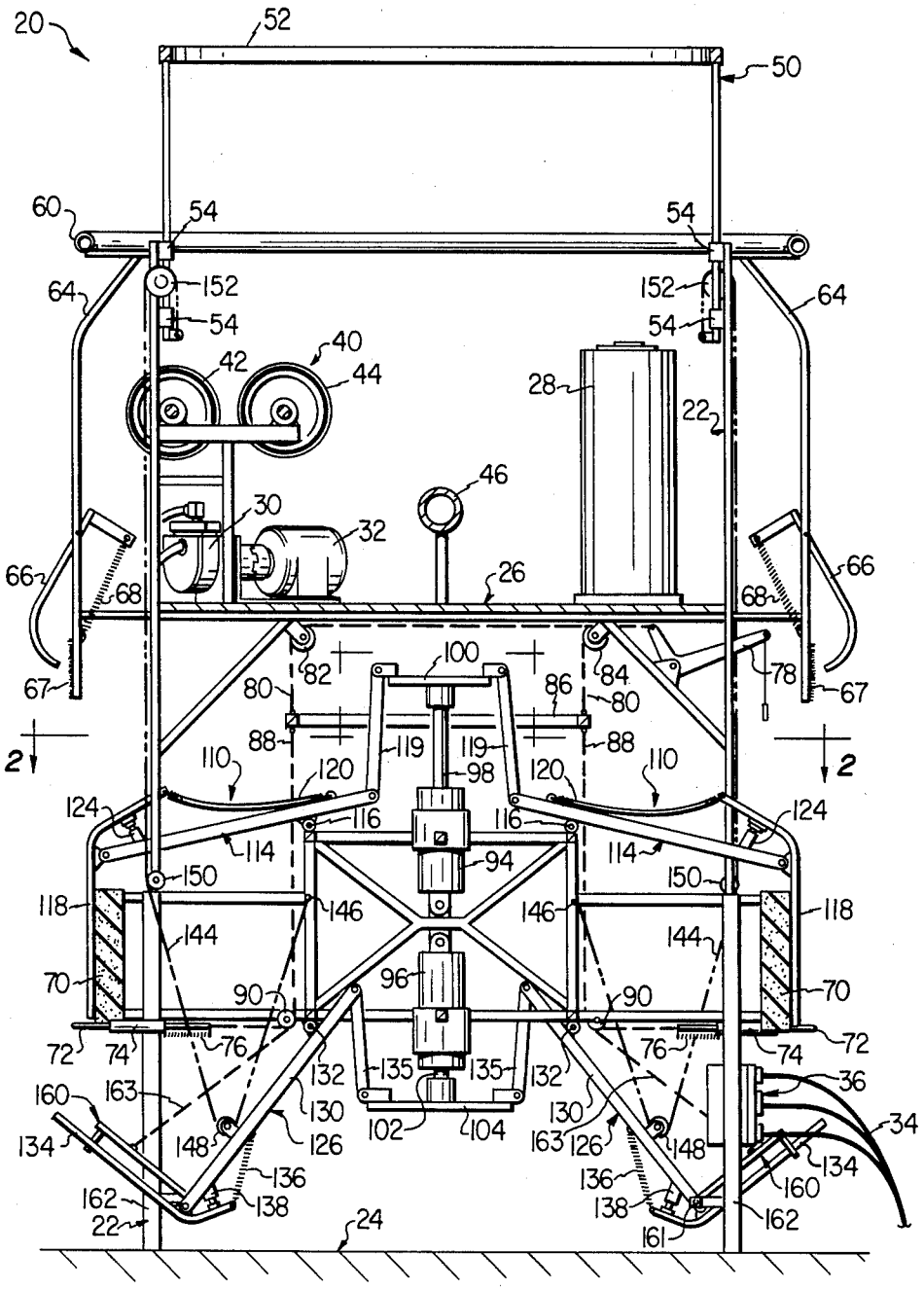
FIG. 1 is a side view of a bag folding apparatus incorporating the invention in which certain parts have been broken away to more clearly illustrate certain features of the invention.

Referring now to the Drawings, FIG. 1 shows an agricultural storage bag folding apparatus 20 incorporating the present invention. The apparatus 20 includes a frame 22 which is supported on an underlying surface 24. The frame 22 includes a platform 26 which supports a hydraulic fluid reservoir 28 and a hydraulic pump 30. The hydraulic pump 30 is driven by an electric motor 32 and serves to supply pressurized hydraulic fluid to the operating instrumentalities of the apparatus 20. Power for operation of the electric motor 32 is supplied through a power supply cable 34 which is connected to the motor 32 through a quick disconnect fixture 36 secured to the lower portion of the frame 22.

The platform 26 further supports means for supporting a quantity of flexible tubular material, such as an unwinding mechanism 40. The mechanism 40 includes a pair of non-driven rollers 42 and 44 which are adapted to receive and rotatably support a roll of tubular plastic material. In the operation of the apparatus 20 tubular plastic material extends from a roll supported by the rollers 42 and 44 around a feeding means, such as an idler roller 46, disposed centrally on the platform 26 and upwardly therefrom about an advancing mechanism 50.

The advancing mechanism 50 functions to withdraw tubular material from the rollers 42 and 44 during the operation of the apparatus 20. The advancing mechanism 50 includes a circular subframe 52 which is supported on the frame 22 by a plurality of guides 54. The guides 54 support the subframe 52 for vertical reciprocation with respect to the platform 26 and the roll of tubular plastic material supported by the rollers 42 and 44.

Surrounding the upper end of the frame 22 and the advancing mechanism mounted thereon is a circular guide 60. A plurality of guide bars 64 extend downwardly from the circular guide 60 and are located at circumferentially spaced points around the periphery of the circular guide 60. Braking levers 66 are pivotally supported on the guide bars 64 and are biased by springs 68 to pivot outwardly from the guide bars 64. Also mounted on each guide bar 64 is a braking pad 67, which may comprise a length of carpet or similar fabric material. The braking pads 67 and the braking levers 66 serve to control the passage of tubular bag material downwardly over the apparatus 20.

Supported below the lower ends of the guide bars 64 on the frame 22 is an annular pad 70 comprising a number of fold supporting surfaces. A plurality of fold support members, such as bag supporting pins 72, are mounted beneath the annular pad 70 and are positioned at circumferentially spaced points around the periphery of the pad 70. Each bag supporting pin 72 is supported in a guide 74 secured to the frame 22 and is biased outwardly by a spring 76. Thus, the springs 76 normally position the pins 72 as shown in FIG. 1, wherein the pins 72 extend radially outwardly substantially beyond the outermost periphery of the annular pad 70. The pins 72 are inwardly retractable under the action of a manually operable lever 78.

The lever 78 is connected to the pins 72 by means of three cables 80 (only two shown) which are trained around pulleys 82 and 84 suspended by the platform 26. The cables 80 are attached to and support a distributor ring 86 at substantially equidistant points about the ring 86. Cables 88 are attached to and extend downwardly from the distributor ring 86 at substantially equidistant locations thereabout, are trained around pulleys 90 mounted on the frame and are attached to the inboard ends of the pins 72. In the embodiment illustrated, eight cables 88 extend from the distributor ring 86, each branching into two ends beyond the pulleys 90. The two ends of each of the cables 88 are connected to adjacent pairs of the pins 72. It will be understood that the eight cables 88 thereby service sixteen pins 72 mounted at equally spaced locations about the frame 22 below the pad 70. Actuation of the lever 78 raises the distributor ring, thereby retracting the pins 72 under the action of the cables 88.

The frame 22 includes a subframe 92 disposed at approximately the same level as the annular pad 70. The subframe 92 in turn supports opposed upper and lower hydraulic cylinders 94 and 96. The upper hydraulic cylinder 94 has a piston rod 98 extending therefrom. Secured to the distal end of the piston rod 98 is a circular plate 100. Similarly, the lower hydraulic cylinder 96 has a piston rod 102 extending therefrom, having a circular plate 104 secured to the distal end thereof.

Figure 2:
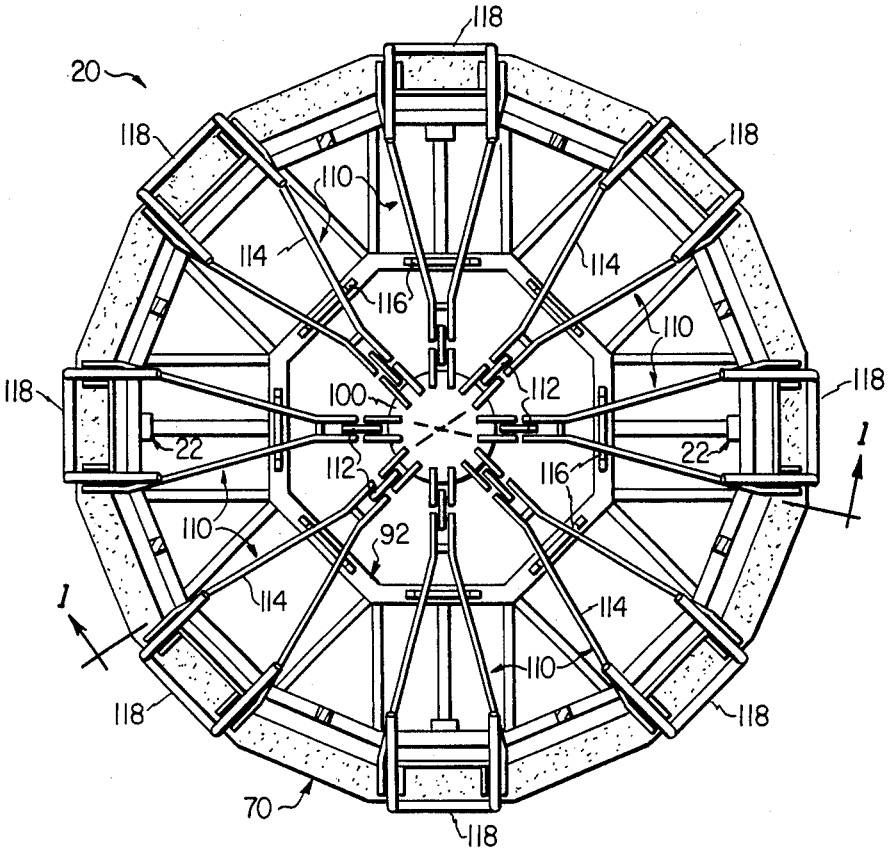
FIG. 2 is a sectional view taken generally along line 2—2 of FIG. 1 in the direction of the arrows wherein certain parts have been omitted for increased clarity.

The upper hydraulic cylinder 94 functions to operate a plurality of upper arms 110. As is best shown in FIG. 2, the upper arms 110 are located at circumferentially spaced points around the periphery of the subframe 92. Each upper arm 110 includes an A-shaped arm 114 which is pivotally supported by the subframe 92 at a point 116. Each A-shaped arm 114 in turn pivotally supports a clamping member 118 at the distal end thereof. Referring again to FIG. 1, each upper arm 110 also includes a link 119 which functions to pivotally interconnect the plate 100 of the upper hydraulic cylinder 94 with one of the A-shaped arms 114. A bungee cord 120 is secured between the upper end of each clamping member 118 and the proximal end of each A-shaped arm 114 to urge the clamping member 118 into engagement with a stop member 124 mounted on the A-shaped arm 114.

Figure 3:
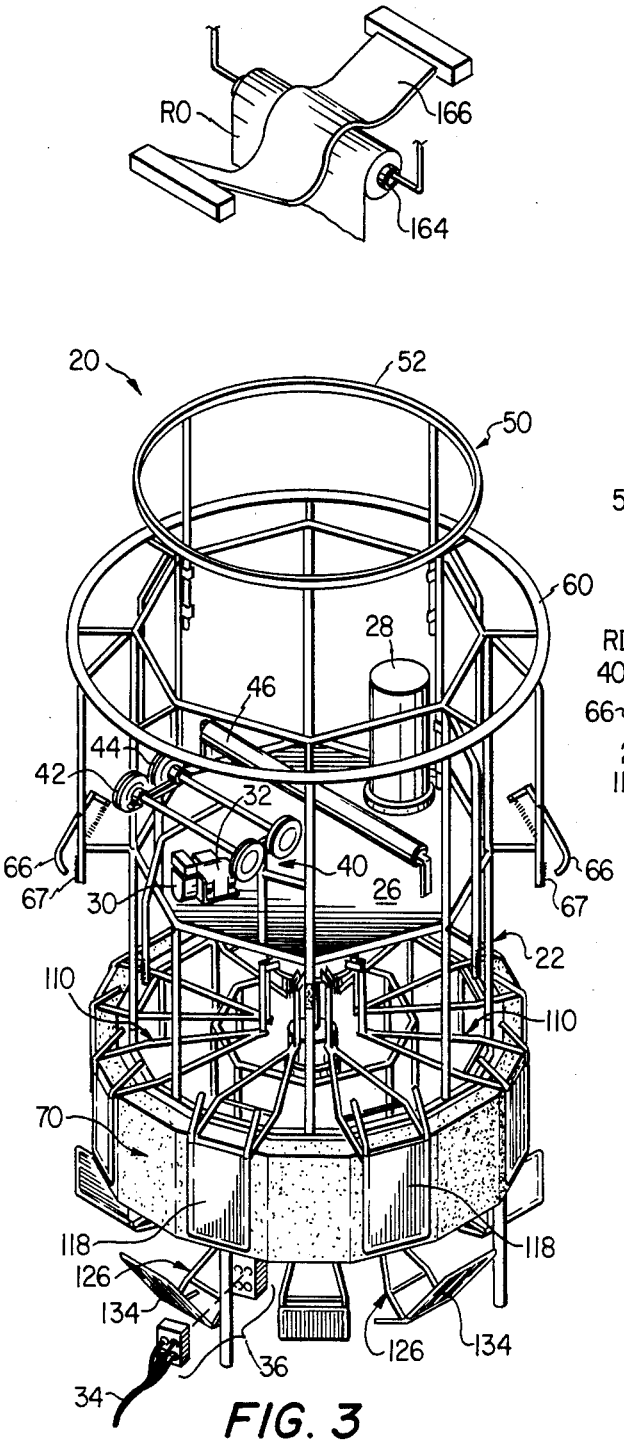
FIG. 3 is a perspective view of the apparatus of FIG. 1 showing the apparatus prior to use.
Figure 4:
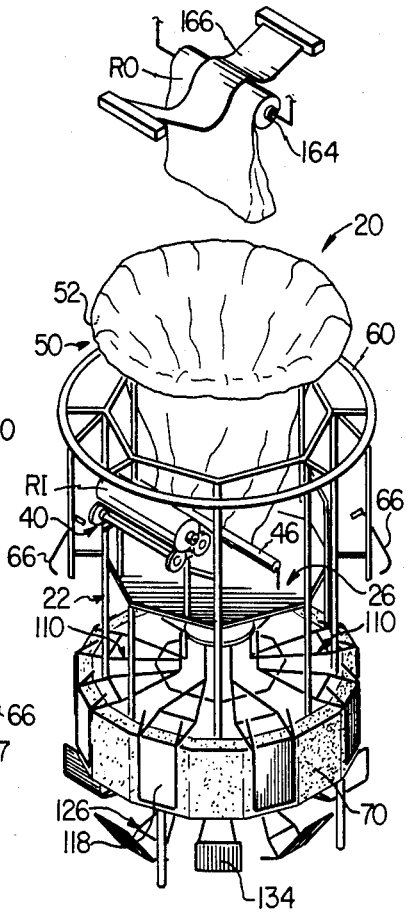
FIG. 4 is a view similar to FIG. 3 illustrating an initial step in the preparation of the apparatus for use.

The hydraulic cylinder 96 controls the operation of a plurality of lower arms 126. As is best shown in FIGS. 3 and 4, the lower arms 126 are located at circumferentially spaced points around the periphery of the frame 22. The lower arms 126 are equal in number to the upper arms 110, and each lower arm 126 is positioned between a pair of corresponding upper arms 110.

Each lower arm 126 includes an A-shaped arm 130, similar to the A-shaped arms 114 of the upper arms 110, which is pivotally supported by the subframe 92 at 132. Each A-shaped arm 130 in turn pivotally supports a clamping member 134 at the distal end thereof. Referring again to FIG. 1, each lower arm 126 also includes a link 135 which serves to pivotally interconnect the plate 104 of the lower hydraulic cylinder 96 with each A-shaped arm 130. An extension spring 136 is secured between each clamping member 134 and the proximal end of each A-shaped arm 130 to urge the clamping member into engagement with a stop member 138 mounted on the A-shaped arm 130.

The lower hydraulic cylinder 96 also operates the advancing mechanism 50 situated at the upper end of the frame 22 by means of a plurality of cables 144. Each cable 144 is connected to the subframe 92 at 146. Each cable 144 is trained around a pulley 148 mounted on one of the A-shaped arms 130 of the lower arms 126 and extends around pulleys 150 supported on the frame 22. The cables 144 extend from the pulleys 150 around pulleys 152 mounted on the upper end of the frame 22 and are thereafter connected to the lower end of the circular subframe 52 of the advancing mechanism 50. Thus, extension of the hydraulic cylinder 96 extends the lower arms 126 upwardly causing upward movement of the pulleys 148. As the pulleys 148 move upwardly, the cables 144 travel through the pulleys 150 and 152, allowing the circular frame 52 to reciprocate downwardly relative to the frame 22 under the action of gravity. Conversely, retraction of the lower hydraulic cylinder 96 retracts the lower arms 126, causing downward movement of the pulleys 148. As the pulleys 148 move downwardly the cable 144 travels through the pulleys 150 and 152, causing the circular subframe 52 to reciprocate upwardly relative to the frame 22.

The apparatus 20 further includes a plurality of lower arm retracting members 160, each servicing one of the lower arms 126. The lower arm retracting members 160 of adjacent lower arms 126 are pivotally mounted on brackets 161 extending from either side of one of four legs 162 supporting the lower end of the frame 22. Attached to and extending from each of adjacent pairs of retracting members 160 on each leg 162 is a cable 163. Adjacent pairs of the cables 163 are connected to one of the cables 88, and thus are ultimately connected to the lever 78 via the distributor ring 86. Therefore, four of the cables 88 extending from the distributor ring 86 each service two of the retracting members 160 and an adjacent pair of the bag supporting pins 72.

B. Preparation

Figure 5:
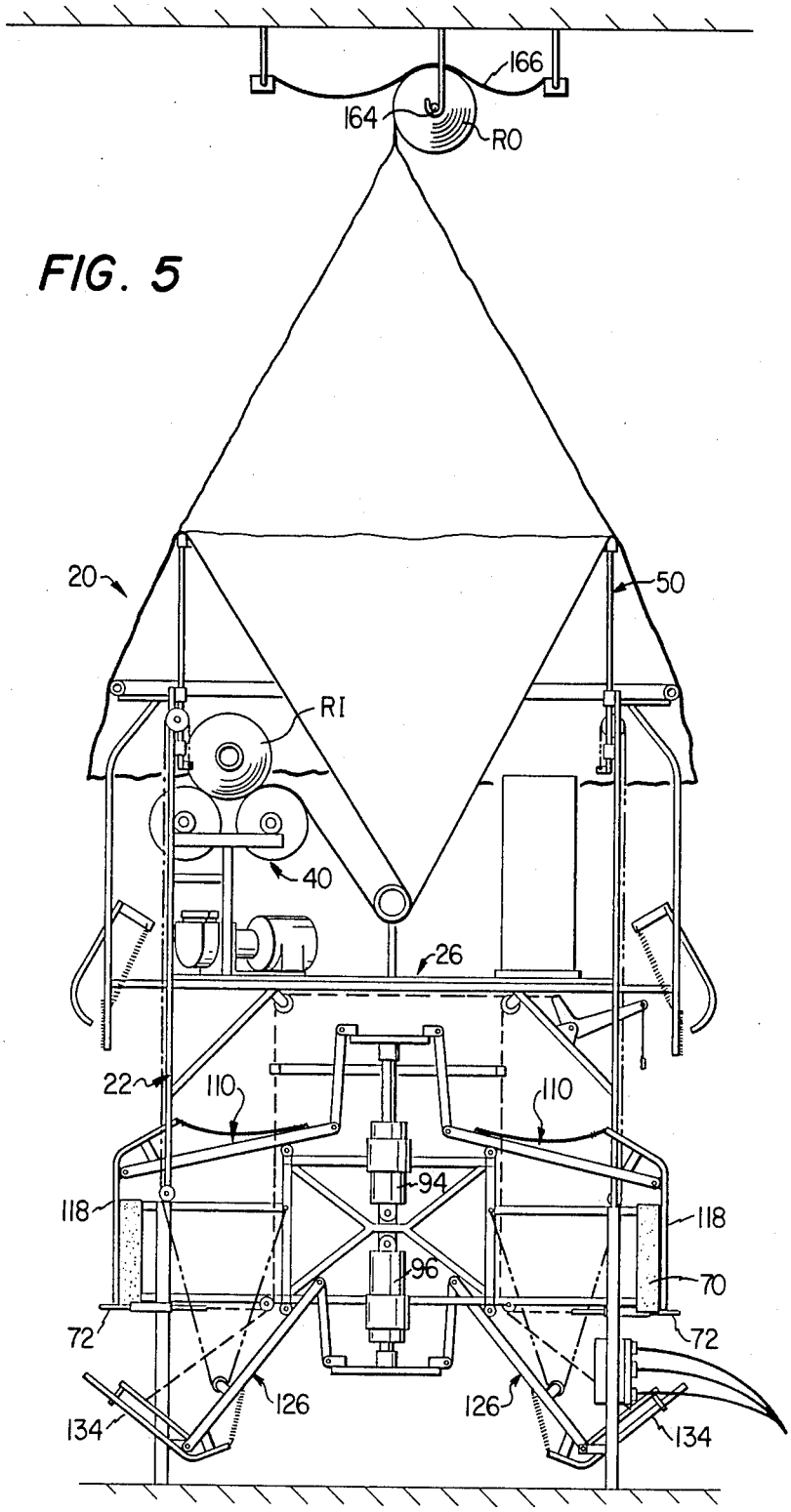
FIG. 5 is a side view of the apparatus illustrated in FIGS. 3 and 4 showing a step in the preparation of the apparatus subsequent to the step shown in FIG. 4.

The procedure involved in preparing the agricultural bag folding apparatus 20 for operation is illustrated in FIGS. 3, 4, and 5. Operating power is supplied to the electric motor 32 from the power supply cable 34 by joining the component parts of the quick disconnect fixture 36. A roll of tubular plastic material RI is positioned on the rollers 42 and 44 comprising the unwinding mechanism 40. Another roll of tubular plastic material RO is rotatably supported on a roller 164 above the frame 22 of the apparatus 20. A suitable braking apparatus 166 is employed to prevent uncontrolled unwinding of the roll of tubular plastic material RO. The braking apparatus 166 may comprise a suitably weighted length of carpet, or similar fabric material.

Referring now to FIG. 4 the leading end of the plastic material comprising the roll RI is first extended arond the roller 46 and then upwardly through the circular subframe 52 comprising the advancing mechanism 50. The leading end of the length of tubular plastic material comprising roll RI is expanded into an encircling relationship with respect to the circular subframe 52 and is then extended downwardly toward the circular guide 60. It will be understood that the length of tubular plastic material comprising RI is turned inside out as it is expanded about the circular subframe 52.

As is best shown in FIG. 5, the leading end of the length of tubular plastic material from the roll RI is extended downwardly into substantial alignment with the circular guide 60. At this point the leading end of the tubular plastic material RO is expanded about the advancing mechanism 50 and the circular guide 60 and is extended downwardly into a surrounding relationship with respect to the leading end of the tubular plastic material from the roll RI. In this manner the leading end of a two-ply agricultural storage bag B is formed, wherein the inner ply comprises material from the roll RI supported on the rollers 42 and 44 and the outer ply comprises material from the roll RO supported on the roller 164.

C. Operation

Figure 6:
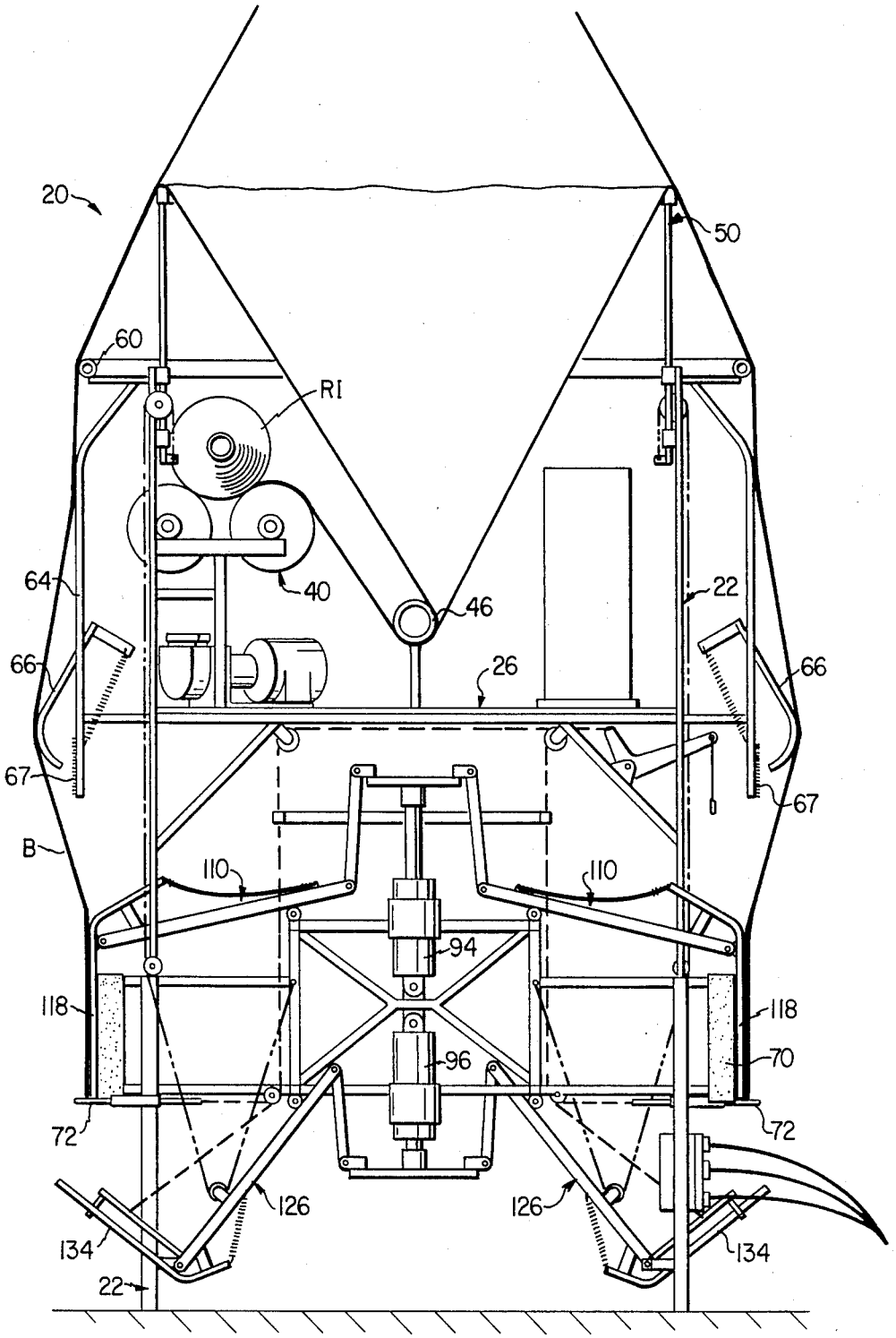
FIGS. 6, 7, 8, 9, and 10 are side views of the apparatus of FIG. 1 illustrating successive steps in the method of the present invention.

The operation of the agricultural bag folding apparatus 20 in performing the method of the present invention is illustrated in FIGS. 6–10. Referring to FIG. 6 in particular, the leading end of the agricultural storage bag B (formed as illustrated in FIGS. 3–5) is advanced downwardly about the annular pad 70 and the clamping members 118 of the upper arms 110, until resting against the pins 72. At this point the pins 72 are fully extended, the upper arms 110 are fully extended, and the lower arms 126 are fully retracted. The agricultural storage bag B is guided in its downward movement relative to the frame 22 of the bag folding apparatus 20 by the circular guide 60 and the guide bars 64. Movement of the agricultural storage bag B is regulated by the braking levers 66 and braking pads 67 which function to prevent the uncontrolled downward movement of the bag.

Figure 7:
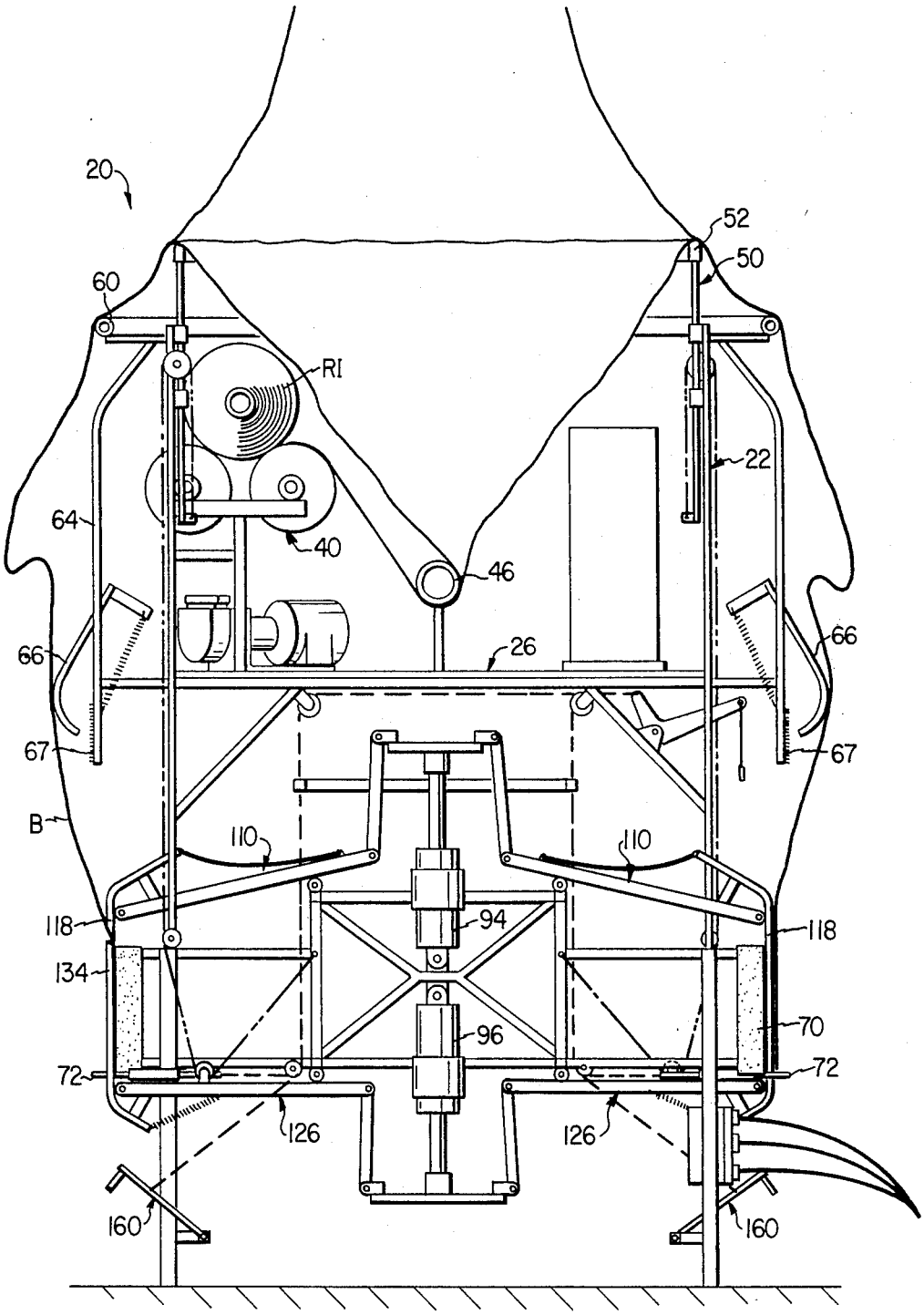

Referring to FIG. 7, the lower hydraulic cylinder 96 is next actuated to extend the lower arms 126. This causes the clamping members 134 of the lower arms 126 to securely clamp the leading end of the agricultural storage bag B against the annular pad 70. Upward movement of the lower arms 126 under the action of a hydraulic cylinder 96 also allows the circular subframe 52 comprising the advancing mechanism 50 to move downwardly, which in turn allows the agricultural storage bag B to move downwardly along the frame 22 of the apparatus 20 under the control of the braking levers 66 and braking pads 67.

Figure 8:
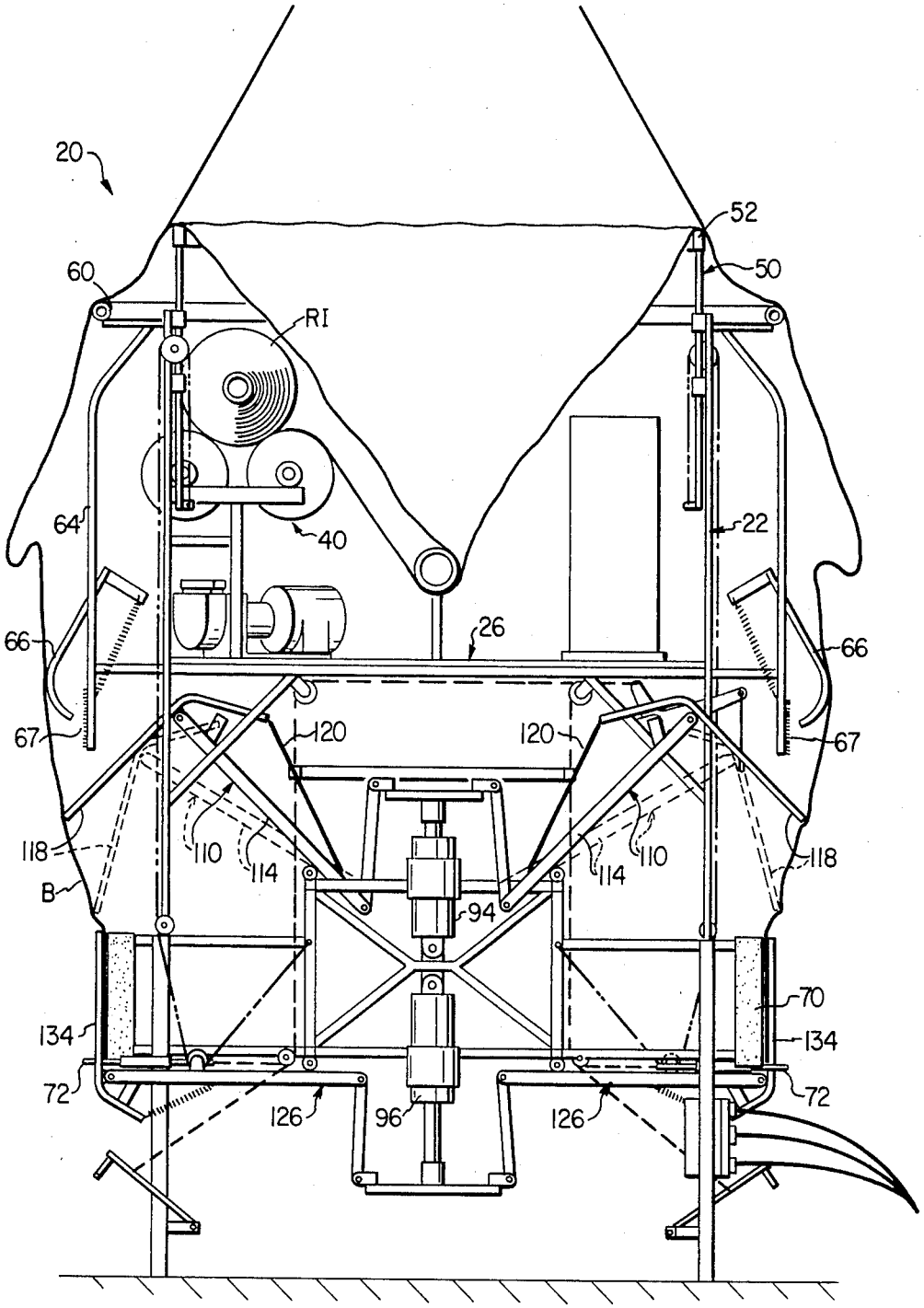

As illustrated in FIG. 8, the upper hydraulic cylinder 94 is next retracted to raise the upper arms 110. As the upper arms 110 are raised, the clamping members 118 are initially moved into the positions illustrated by broken lines in FIG. 8, wherein the leading end of the agricultural storage bag B pivots the clamping members 118 toward their respective A-shaped arms 114 against the tension of the bungee cords 120. As the upper arms 110 are raised further the clamping members 118 are fully withdrawn from the leading end of the agricultural storage bag B and are then snapped outwardly under the action of the bungee cords 120 into the positions illustrated by full lines in FIG. 8. During this operation the leading end of the agricultural storage bag B remains tightly clamped against with the annular pad 70 by the clamping members 134 of the lower arms 126.

Figure 9:
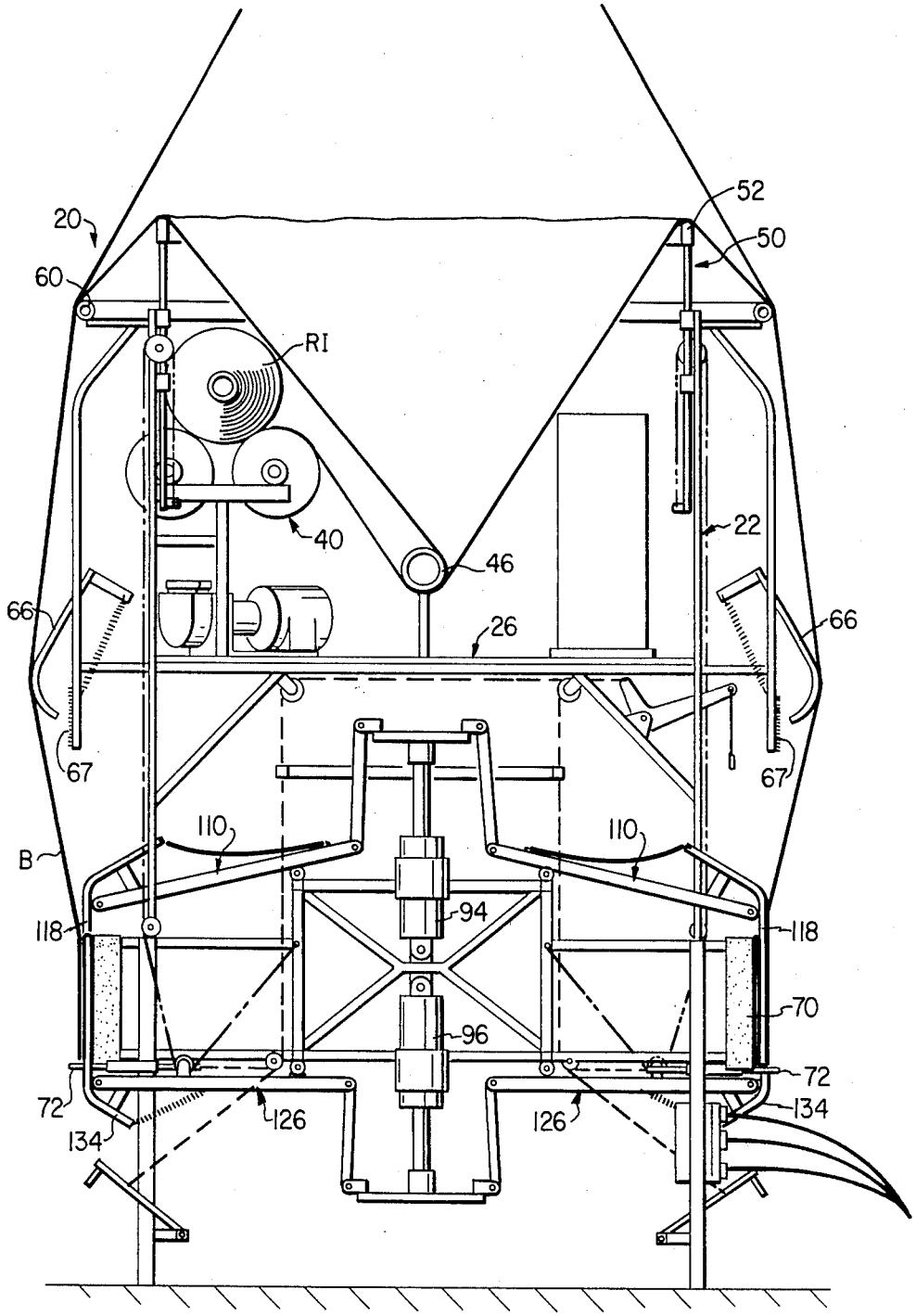

Referring to FIG. 9, the upper hydraulic cylinder 94 is next actuated to extend the clamping members 118 of the upper arms 110 into a clamping relationship with respect to the annular pad 70. During this operation the portion of the agricultural storage bag B that is immediately adjacent to the leading end of the bag B is folded downwardly over the clamping members 134 of the lower arms 126, thus forming a first fold in the agricultural storage bag B. At this point the first fold is securely clamped against the annular pad 70 under the action of the clamping members 118 of the upper arms 110.

Figure 10:
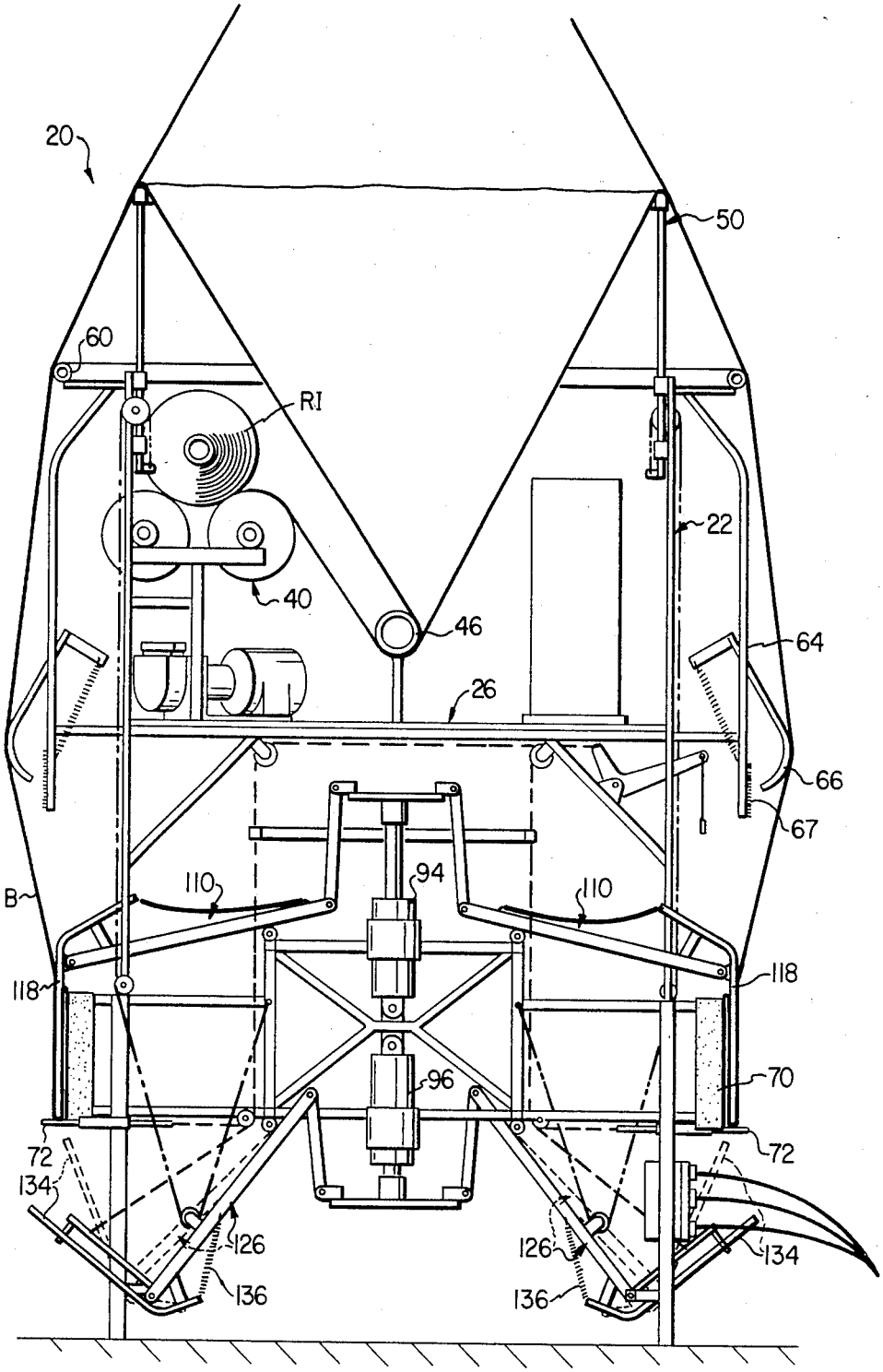

The next step in the operation of the apparatus 20 comprises actuation of the lower hydraulic cylinder 96 to retract the lower arms 126. As shown in FIG. 10, the clamping members 134 of the lower arms 126 are initially moved into the positions shown by broken lines wherein the first fold of the agricultural storage bag B pivots the clamping members 134 toward their respective A-shaped arms 130 against the tension of the extension springs 136. As the lower arms 126 are retracted further the clamping members 134 are fully withdrawn from the first fold of the agricultural storage bag B and are then snapped outwardly under the action of the extension springs 136 into the positions shown by full lines in FIG. 10. At this point to component parts of the apparatus 20 are positioned as shown in FIG. 6, except that a first fold has been formed in the agricultural storage bag B has been foregoing steps are then repeated until the entire length of the agricultural storage bag B has been accumulated in a series of flat folds each extending parallel to and having substantially the same vertical dimension as the annular pad 70.

Referring now to FIGS. 8 and 9, each actuation of the upper arms 110 to effect the folding of the agricultural storage bag B consumes substantially all of the tubular plastic material released as the advancing mechanism 50 is lowered. Therefore, when the lower arms 126 are retracted in the manner illustrated in FIG. 10, thereby raising the circular subframe 52 of the advancing mechanism 50, additional tubular plastic material is withdrawal from the roll RI supported on the rollers 42 and 44. It has been found in practice that the advancing mechanism 50 comprises a highly efficient means of controlling both the amount of tubular plastic material withdrawn from the roll RI and the timing or frequency of such withdrawal.

Figure 11:
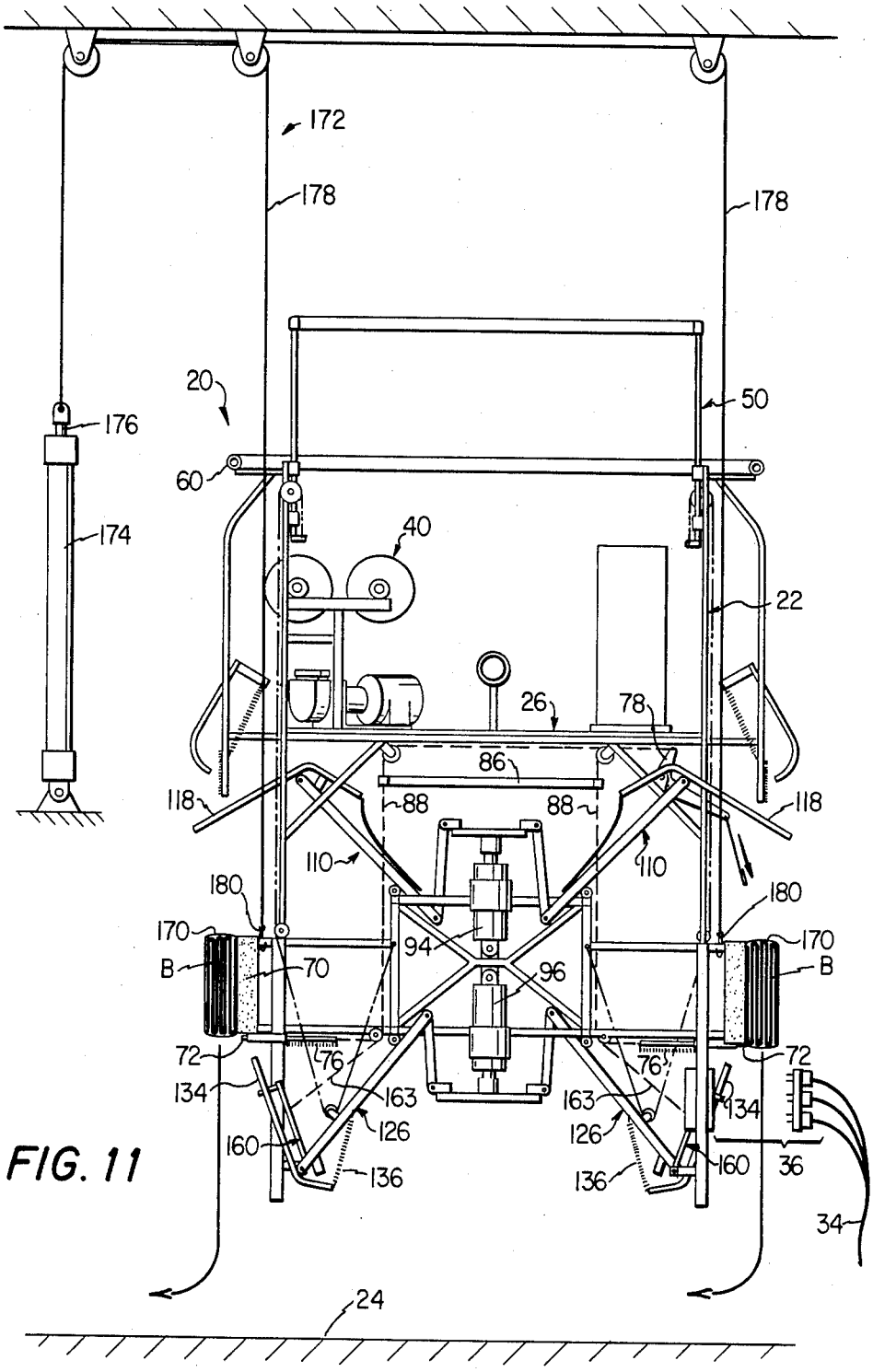
FIG. 11 is a side view of the apparatus illustrated in the preceding Figures illustrating removal of a flat-folded agricultural storage bag from the apparatus.

FIG. 11 illustrates the apparatus 20 with the agricultural storage bag B in a fully folded condition. Elongate flexible members 170, which may comprise cords, plastic strapping material, etc., are secured around the folds comprising the agricultural storage bag B at circumferentially spaced points in order to retain the bag in the folded condition.

After the elongate flexible members 170 are secured in place the lever 78 is actuated thus allowing removal of the fully folded agricultural storage bag B. The lever 78 functions through the distributor ring 86 and all eight of the cables 88 to retract the pins 72 against the action of the springs 76. The lever 78 also operates through the distributor ring 86, four of the cables 88 and the cables 163 connected to the cables 88 beyond the pulleys 90 to actuate the retracting members 160, thereby pivoting the clamping members 134 of the lower arms 126 inwardly against the action of the springs 136. the quick disconnect fixture 36 is then released, thereby separating the power supply cable 34 from the apparatus 20. A lifting mechanism 172, which may comprise a fluid powered cylinder 174 hving a piston rod 176 connected to a plurality of cables 178, which are in turn connected to attaching members 180, is then employed to lift the frame 22 of the apparatus 20 out of engagement with the underlying surface 24. At this point the folded agricultural storage bag B is removed from the apparatus 20, whereupon it is packaged for shipment.

Although specific embodiments of the invention have been illustrated in the accompanying Drawings and described in the foregoing Detailed Description, it will be understood that the invention is not limited to the embodiments shown, but is capable of numerous rearrangements, modifications, and substitution of parts and elements without departing from the spirit of the invention.

We claim:

1. An apparatus for folding flexible tubular material, comprising:

a frame having an upper end and a lower end;

a plurality of fold supporting surfaces mounted about the periphery of the frame between the upper and lower ends thereof for supporting successive folds of flexible tubular material;

aligning means beyond the supporting surfaces for aligning successive portions of the flexible tubular material with the fold supporting surfaces;

a plurality of upper arms mounted on the frame about the fold supporting surfaces for movement between retracted and extended positions;

a plurality of lower arms mounted on the frame below the fold supporting surfaces for movement between retracted and extended positions;

actuating means mounted on the frame for alternately extending and retracting the upper and lower arms into and out of engagement with the fold supporting surfaces and thereby forming the flexible tubular material into a series of folds each extending parallel to the fold supporting surfaces;

an unwinding mechanism for supporting a roll of flexible tubular material within the frame adjacent the upper end thereof; and an advancing mechanism, including a subframe slidably mounted on the upper end of the frame and means for reciprocating said subframe upwardly a predetermined distance above the upper end of the frame, thereby withdrawing tubular flexible material upwardly from the unwinding mechanism and downwardly a predetermined distance toward the upper end of the frame, thereby releasing the flexible tubular material for movement toward the fold supporting surfaces.

2. The apparatus for folding flexible tubular material according to claim 1 further comprising a power supply means for supply operating power to the apparatus, the power supply means including a quick disconnect fixture for immediate disconnection of the power supply means to facilitate removal of the folded flexible tubular material from the apparatus.

3. The apparatus for folding flexible tubular material according to claim 1 further comprising guide means mounted on the frame between the upper end of the frame and the fold supporting surfaces for controlling movement of the flexible tubular material from the advancing mechanism to the fold supporting surfaces.

4. The apparatus for folding flexible tubular material according to claim 3 wherein the guide means includes a circular guide extending outwardly from and surrounding the upper end of the frame for receiving surfaces.

5. The apparatus for folding flexible tubular material according to claim 1 wherein said means for reciprocating comprises actuating means mounted on the frame for reciprocating the subframe upwardly above the upper end of the frame in response to movement of the lower arms into their retracted positions and for reciprocated the subframe downwardly toward the upper end of the frame in response to movement of the lower arms into their extended positions.

6. The apparatus for folding flexible tubular material according to claim 1 wherein the unwinding mechanism includes a pair of parallel rollers mounted within the upper end of the frame for rotatably supporting a roll of tubular flexible material and a roller mounted within the upper end of the frame below the center of the advancing mechanism for guiding tubular flexible material from the unwinding mechanism upwardly to the advancing mechanism.

7. The apparatus for folding flexible tubular material according to claim 1 wherein the upper and lower arms are pivotally mounted within the frame for pivotal movement between their extended and retracted positions and extend radially outwardly to a plurality of clamping members which grip the tubular plastic material against a plurality of the fold supporting surfaces when their respective upper and lower arms are in their extended positions.

8. The apparatus for folding flexible tubular material according to claim 7 wherein the clamping members are pivotally mounted for movement from a position substantially parallel to the fold supporting surfaces when the upper and lower arms are in their extended positions toward the point at which each upper and lower arm is pivotally mounted on the frame as the arms pivot toward their retracted positions, and further including extending means connected to the arms for urging the clamping members outwardly away from the points at which the upper and lower arms are pivotally mounted on the frame.

9. The apparatus for folding flexible tubular material according to claim 1 further comprising a plurality of retractable fold support members normally extending from the frame outwardly beyond the fold supporting surfaces for supporting a plurality of folds of flexible material that have accumulated on the fold supporting surface.

10. The apparatus for folding flexible tubular material according to claim 1 further comprising expanding means mounted on the frame for guiding and expanding the flexible tubular material as it is advanced toward the fold supporting surfaces and for frictionally resisting the advance of the flexible tubular material.

11. An apparatus for folding flexible tubular material, comprising:

a frame having an upper end and a lower end;

a plurality of fold supporting surfaces mounted circumferentially about the frame adjacent the lower end thereof for supporting successivefolds of flexible tubular material;

aligning means beyond the supporting surfaces for positioning the flexible tubular material in alignment with the fold supporting surfaces;

an array of lower arms each extending radially outwardly from the frame below the fold supporting surfaces at spaced apart locations for movement from a retracted position into an extended position to grip the flexible tubular material against the fold supporting surfaces;

an array of upper arms each extending radially outwardly from the frame above the fold supporting surfaces at spaced apart locations for movement from a retracted position into an extended position to fold the flexible tubular material downwardly about the extended lower arms and to grip the fold against the fold supporting surfaces;

upper arm actuating means for selectively pivoting the upper arms between their extended and retracted positions;

lower arm actuating means for selectively pivoting the lower arms between their extended and retracted positions;

the array of upper arms and the array of lower arms engaging the fold supporting surfaces at alternate locations;

support means mounted on the frame for supporting a quantity of flexible tubular material within the frame above the upper arms; and an advancing mechanism for advancing material from the material supporting means to the fold supporting surfaces and including a subframe slidably mounted on the upper end of the frame for reciprocation with respect thereto and means for reciprocating said subframe to alternatingly withdraw flexible tubular material from said support means and release the flexible tubular material for movement towards said fold supporting surfaces.

12. The apparatus for folding flexible tubular material according to claim 11 wherein the upper and lower arms include clamping members pivotally mounted on and extending toward the fold supporting surfaces for gripping the flexible tubular material against the fold supporting surfaces.

13. The apparatus for folding flexible tubular material according to claim 12 wherein the clamping members pivot inwardly toward the frame as the upper and lower arms are retracted from folds of flexible tubular material that have accumulated on the fold supporting surfaces and further comprising means for urging the clamping members outwardly from the frame as the upper and lower arms are retracted.

14. The apparatus for folding flexible tubular material according to claim 12 further comprising retractor means for selectively pivoting the clamping members of the lower arms toward the points at which the lower arms are pivotally supported on the frame when the lower arms are in their retracted positions, thereby allowing the folded flexible tubular material to be withdrawn over the lower arms and the lower end of the frame.

15. The apparatus for folding flexible tubular material according to claim 11 wherein the support means for supporting a quantity of flexible tubular material includes mounting means within the frame for rotatably mounting a roll of tubular flexible material within the frame adjacent the upper end thereof and feeding means mounted within the frame beneath the center of the advancing mechanism for guiding tubular flexible material from the roll mounting means and upwardly within the subframe of the advancing mechanism.

16. The apparatus for folding flexible tubular material according to claim 11 further comprising a guide member extending outwardly from and surrounding the upper end of the frame for expanding and guiding the flexible tubular material.

17. The apparatus for folding flexible tubular material according to claim 16 further comprising a plurality of longitudinal guide members mounted on the frame and extending downwardly from the guide member surrounding the upper end of the frame toward the upper arms for controlling movement of the flexible tubular material relative to the frame.

18. The apparatus for folding flexible tubular material according to claim 17 further comprising braking means mounted on and extending from the longitudinal guide members for frictionally resisting the advance of flexible tubular material.

19. The apparatus for folding flexible tubular material according to claim 11 wherein the aligning means comprises a number of retractable fold support members mounted on the frame below the fold supporting surfaces and normally extending radially outwardly therefrom beyond the fold supporting surface for supporting the folded flexible tubular material.

20. The apparatus for folding flexible tubular material according to claim 11 further comprising a power supply means mounted on the frame for transmitting operating power from an external source to the apparatus, the power supply means including a quick disconnect fixture for facilitating the removal of the folded flexible tubular material from the apparatus.

21. The apparatus for folding flexible tubular material according to claim 11 further comprising expanding means mounted on the frame between the upper end of the frame and the fold supporting surfaces for guiding the flexible tubular material over the frame and for frictionally resisting the advance of the material toward the fold supporting surfaces.

* * * * *